US007032336B2

(12) United States Patent
Bedretdinov

(10) Patent No.: US 7,032,336 B2
(45) Date of Patent: Apr. 25, 2006

(54) COMPACT AUTOMATIC IRONING PRESS FOR TROUSERS

(75) Inventor: Amir Khasianovich Bedretdinov, Geneva (CH)

(73) Assignee: Exeq S.A., Geneva (CH)

( * ) Notice: Subject to any disclaimer, the term of this patent is extended or adjusted under 35 U.S.C. 154(b) by 82 days.

(21) Appl. No.: 10/487,598

(22) PCT Filed: Aug. 29, 2001

(86) PCT No.: PCT/IB01/01554

§ 371 (c)(1),
(2), (4) Date: Feb. 24, 2004

(87) PCT Pub. No.: WO03/017808

PCT Pub. Date: Mar. 6, 2003

(65) Prior Publication Data

US 2004/0237356 A1 Dec. 2, 2004

(51) Int. Cl.
*D06F 71/28* (2006.01)

(52) U.S. Cl. ..... 38/14; 38/71

(58) Field of Classification Search ..... 38/14, 38/39, 70, 72, 1 R, 3, 12, 15, 16; 223/63, 223/69, 70, 72, 73, 74; 100/295; 219/243, 219/250

See application file for complete search history.

(56) References Cited

U.S. PATENT DOCUMENTS

| | | | | |
|---|---|---|---|---|
| 2,065,235 A | | 12/1936 | Matthews | |
| 2,147,596 A | * | 2/1939 | Long | 223/57 |
| 3,145,490 A | * | 8/1964 | Corby | 38/71 |
| 4,611,419 A | | 9/1986 | Duplessy et al. | |
| 4,783,916 A | * | 11/1988 | Whitehead | 38/71 |
| 5,359,792 A | * | 11/1994 | Hanada et al. | 38/72 |
| 5,542,199 A | * | 8/1996 | Dreisbach et al. | 38/12 |

FOREIGN PATENT DOCUMENTS

| | | |
|---|---|---|
| DE | 12 54 114 | 11/1967 |
| DE | 19 08 175 | 9/1970 |
| DE | 20 61 562 | 7/1972 |

* cited by examiner

*Primary Examiner*—Ismael Izaquirre
(74) *Attorney, Agent, or Firm*—Young & Thompson

(57) ABSTRACT

A portable automatic ironing press for trousers includes two housings each having a rectangular pressing ironing plate pivotally mounted on a base. A central dividing plate is rigidly connected to the base and has a cut in its top part located between the pressing ironing plates while at least one of the plates has a heating element. The base has a lower horizontal part and at least one lateral vertical part rigidly linked to each other. The vertical part of the base includes guiding elements and an extended shaft bearing an arm. In the base of the press are located the electronic control bloc, control board and at least one driving gear to guide the tools to open and press the pressing ironing plates and operate the extended shaft. The housing includes windows through which the lower part of the trousers can be discharged.

11 Claims, 6 Drawing Sheets

COMPACT AUTOMATIC IRONING PRESS FOR TROUSERS

The present invention relates to domestic appliances and more particularly to an automated ironing press. More specifically the invention has for object a compact automated device for ironing the trousers that can be used at home or in hotels or the like.

Known devices, like for instance the trousers press disclosed in the U.S. Pat. No. 4,611,419 includes two ironing boards and a central heating plate sandwiched between the two ironing boards. The heating plate has a cut in its upper part to receive the waist and inter legs of the trousers. Once the trousers are in place the ironing boards are pivoted so as to be urged against the central heating plate and the ironing process can take place. Although the description of the know device says that he pressing is automatic, the above mentioned device does not include any automation means that allow a complete ironing process without user intervention. Accordingly, the majority of functions during its use are manual and require user actions.

Furthermore, the top part of the trousers is left untreated.

The goal of the present invention is to overcome the above mentioned drawbacks and to provide a truly automated ironing press for trousers.

It is therefore an object of the present invention to provide an ironing press for ironing the trousers that can automatically iron the whole length of the trousers as well as the topside of the trousers.

A further object of the invention is to provide an ironing press that is compact, easy to use and economic to manufacture.

This goal is achieved by providing a portable automatic ironing press for the trousers that is designed in a compact casing. In that casing a pair of rectangular pressing ironing plates are movably mounted on the base of the casing on each side of a dividing plate also fixed on the base of the casing. The pressing ironing plates are movable from one open position allowing the insertion of a pair of trousers on the dividing plate to a closed position during the ironing process. The dividing plate, located between the two ironing plates has a cut in its top part to accommodate the waist of the trousers. Closing means driven by a motor are provided to urge the two pressing ironing plates against the central dividing plates when the ironing process occurs. At least one of the three plates has a heating element. The casing also comprises a holding device, designed as a vertically movable extending axle which is connected to an horizontal arm that comprises gripping means for holding the waist of the trousers. In the base of the casing are located the electronic control bloc, control panel and at least one driving gear to guide the closing means linked to the pressing ironing plates and to control the vertical displacement of the extending axle during operation.

According to one preferred embodiment of the invention, the dividing plate is firmly mounted on the base of the casing and each pressing ironing plate is pivoted on its turning axle and includes a heating element.

In accordance with another feature of the invention, the lower parts of the casing have windows to discharge the lower parts of the trousers from the press, while folding doors are provided to close said windows. The press also includes means for catching and stretching the lower part of the trousers. These means can be designed as a pressing device on rollers, one of them is guiding and another one works with the friction. Alternatively, these catching means can be designed as an endless belt installed on rollers.

The horizontal arm connected to the extending axle preferably includes means for stretching the waist of the trousers.

The press according to the invention advantageously comprises a water tank, a motor driven pump, connecting pipes and spraying nozzles to humidify the trousers during the ironing process.

An external control panel gives the user the possibility to set up and change the different working condition of the ironing press.

The ironing press for trousers according to the invention allows the automatic ironing of the trousers excluding the deformation and damage of the fabric. The ironing press is simple and comfortable to use, and at the same time it is safe and economic under working conditions. Furthermore, the ironing press of the invention is compact and not expensive to manufacture.

Other aspects and advantages will become evident from the following detailed description of one embodiment of an ironing press according to the invention made with reference to the accompanying schematic and non limiting drawings in which.

Figure 1:
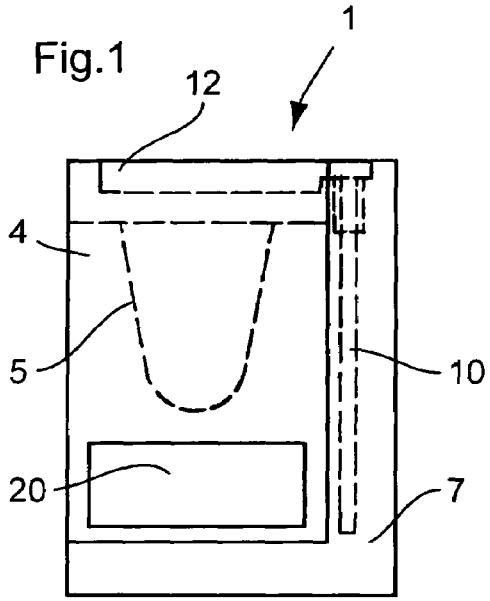
FIG. 1 is a front view of the ironing press according to the invention in a closed position.
Figure 2:
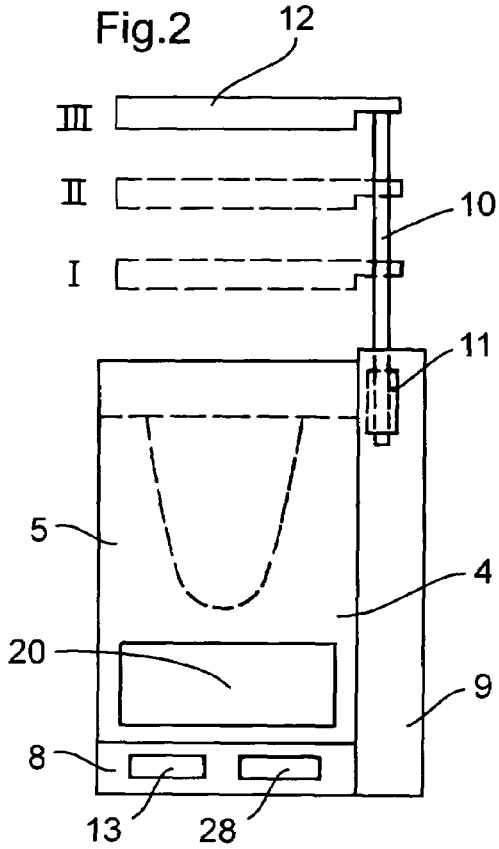
FIG. 2 is a front view of the ironing press in open position with the extending holding arm in three different positions.
Figure 3:
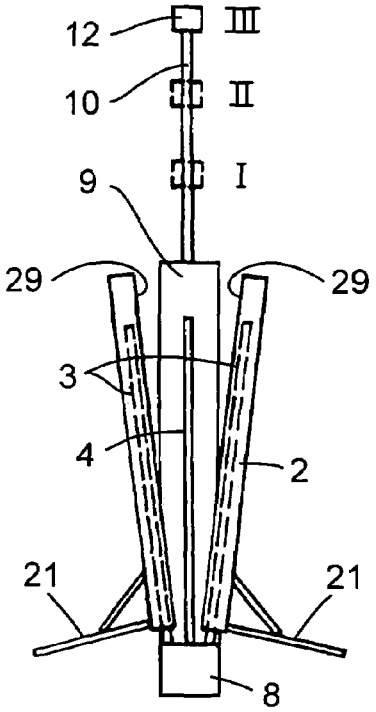
FIG. 3 is a side view of the press shown at FIG. 2.
Figure 4:
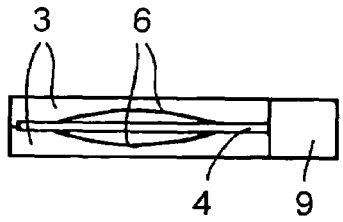
FIG. 4 is view from the top of the press depicted at FIG. 1.

Referring to FIG. 1 to 4, the press 1 is illustrated in the closed position at FIGS. 1 and 4 and in open position at FIGS. 2 and 3 with the different working positions I II III shown at FIGS. 2 and 3. The ironing press 1 comprises two light inserted plastic housings 2, articulated on a base 7 and a dividing plate 4 also mounted on the base 7 and located in between the two housing 2. The base 7 of the press 1 includes the horizontal lower part 8 and a vertical lateral part 9 which are rigidly linked together Preferably, each pressing ironing plate 3 is articulated thanks to and independent shaft on the base 8 and the dividing plate 4 is firmly linked to the base 8. Such preferred arrangement confers a rigid construction to the press allowing an effective ironing process.

In an alternate embodiment, the pressing ironing plates 3 are articulated on the base thank to a common turning shaft and the dividing plate 4 is installed in such a way to have a possible small displacement relative to the pressing ironing plates 3.

The central dividing plate 4 has a curved cut 5 in its upper part. This cut 5 is conformed so as to accommodate the inter-legs part of a pair of trousers.

In the preferred described embodiment, the ironing plates 3 have folded upper surfaces 6 having a concave recess in their upper part (see FIG. 4), linked by form with the cut 5 of the dividing plate 4. This arrangement allows the insertion of the trousers in the press in the following manner: One leg of the trousers is located against one side of the dividing plate 4, the other leg being located on the opposite side of the dividing plate. The inter-legs part is in the cut 5 and the waist of the trousers is at the top side of the dividing plate. This allows the ironing of the total length of the trousers including their top part while the press is activated.

The pressing ironing plates 3 can be manufactured from different materials, for example from metal, ceramic, etc. and the dividing plate 4 has a usual rigid base (metal, plastic, wood etc.) covered by soft casing including sheet wading, fabric or other materials. The base 7, 8, 9 can be made from metal, plastic (moulded or pressed) or composite. In the composite base, the different components may be welded, bolted or fixed by other way.

In an alternate embodiment, the press 1 can be designed with a second lateral vertical part 9. The vertical parts are installed on both side of the pressing ironing plates so that the rigidity of the construction is increased. A second vertical element 9 offers additional space for control element and facilitate tools installation for the mechanism that open and closes the press as it will be described hereunder.

The vertical part 9 comprises in its top part a guiding member 11 that guide an extended shaft 10 vertically moveable under the action of a driving gear. The extended shaft 10 is rigidly linked to an horizontal arm 12. The arm 12 comprises a device 40 for hanging and holding the waist of the trousers that can take any known form( see for example FIG. 10). Preferably, the holding device of the arm 12 will include two or more hanging device linked together with a spring so as to stretch the waist of the trousers to be ironed.

The press is designed to be connected to a traditional power supply. The press control mechanism includes the electronic control bloc and also the control panel allowing the automatic ironing working conditions.

The control panel includes the tools to set up the working conditions by operation means and signal elements such as handles, buttons etc. The press can have different working conditions according to the invention. The control panel give the user the possibility to set-up and change parameters of the ironing process. Parameters are for example temperature and duration of ironing. The control panel may also include pre-set functions defining working conditions, temperature and timing conditions as per trouser (fabric, size, and style) or per user choice.

Preferably, the electronic control bloc 13 and at least one driving gear for operating the press are installed in the lower part 8 of the base. This driving gear drives the open/close means of the ironing plates 3 as well as the operation of the extended shaft 10.

Obviously, more than one common driving gear can be installed, for example, one used to open and press the pressing ironing plates 3 against the central dividing plate 4 and another one to operate the extended arm 12 mounted on the shaft 10. The driving gear for the device to open and press the pressing ironing plates 3 and operate the extended shaft 10 are generally designed as electric gear motor with transmission means, for example as pulley and cables, as system of pinion, as moveable screws and sliders etc. Naturally it is possible to use appropriate transmissions of other types.

Figure 5:
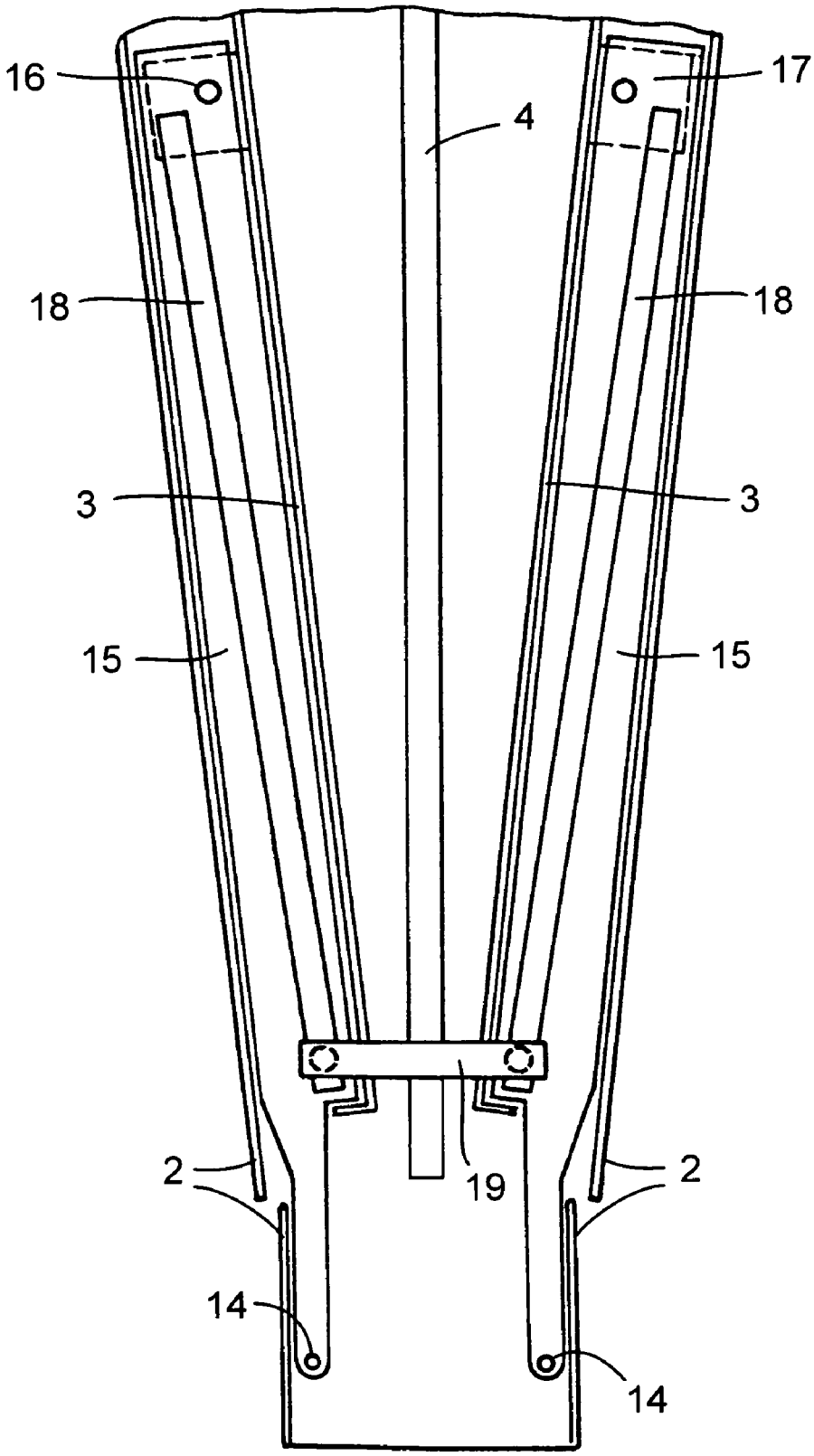
FIG. 5 is a partial cross sectional side view of the ironing press showing the closing mechanism.

FIG. 5 shows a possible implementation of the mechanism used to open and press the pressing ironing plates 3. The dividing plate 4 is rigidly fixed in the base and each pressing ironing plate 3 is pivoted on the base 7. Each pressing ironing plate 3 has its independent turning axle 14. The fixation of the pressing ironing plates 3 to the base is achieved by shaft link, this example shows the installed extended hinges 15 that maintain the pressing plates 3 to the base, said hinge pivotally mounted on the axles 14. There are different ways to fix the pressing plates 3 on the hinges 15. The fixation can be rigidly done by one welded frame. The preferred version of the realisation of the invention shown in FIG. 5, the fixation is done at the axes 16 through bracket 17 rigidly linked with the pressing ironing plate 3. Such way to fix the pressing ironing plate 3 at the hinges 15 (FIG. 5) allows the pressing ironing plate 3 to do a small swinging movement relatively to the hinge 15. This way of fixing the ironing plates 3 improves the ironing quality by adapting the pressing plates during the ironing of the trousers of different sizes, different fabric thickness and different style. The hinges 15 comprise longitudinal inclined slots 18 where a slider 19 element can be moved along the vertical axis. The slider element 19 may have, by way of example, rollers at its both end engaged in the slots 18. The slider movement toward the upper part of the device closes and urges the two pressing ironing plates 3 against the central dividing plate 4. As the slots (18) are inclined, the pressing ironing plate 3 are firmly urged against the central plate 4 when the slider 19 is in the upmost position. By moving down the slider element 19, the press opens. Preferably the slider element 19 will be driven thanks to an electric motor coupled with appropriate transmission means like for example an endless screw.

Referring back to FIG. 1 to 4, the two lateral side of the housing 2 are provided with openings or windows 20 in their lower part. These windows 20 allow to discharge the lower part of the trousers from the press when the arm 12 goes down. Windows 20 are closed thanks to folding doors 21 that receive the lower part of the trousers during the ironing process.

Opening and closing mechanism of the folding doors 21 will now be described with reference to FIGS. 6 and 7. Said mechanism includes in this embodiment the hinges 22 articulated around axles 23 and rigidly linked to axle 24. Sliders 25 are mounted around axles 24 and connected to folding doors 21 thank to levers 27. The sliders 25 can move along axles 24 against the action of springs 26. Sliders 25 are linked to the opening/closing mechanism of the pressing ironing plate 3 and are actuated by the slider 19. Thanks to this arrangement, the folding doors 21 open when the pressing ironing plates 3 open and close when the press closes. During the opening of the press, the slider 19 is moved down and interact with the sliders 25 against the action of springs 26. When the pressing ironing plate 3 are closing, the slider 19 is moved up and releases the sliders 25. Sliders 25 recover their rest position thanks to the springs 26, therefore closing the folding doors 21 to which they are linked through levers 27.

Alternatively, the opening and closing mechanism of the folding doors 21 can be done as cogged gear and flexible connection or other known mechanical equivalent.

Between the lower edge of the dividing plate 4 and the window 20 a guiding surface 30 is provided to guide the lower part of the trousers when discharged through the windows 20. This guiding surface 30 can be designed as one part with the casing of the lower part of the base.

According to a preferred embodiment of the invention, the press is also provided with catching and stretching means. These means are designed to catch and stretch the lower part of the trousers so as to enable the smooth extraction of the lower part of the trousers through the windows 20 during the ironing process.

Said catching means are linked with the driving gear that controls the shaft 10 extension and may be actuated when the arm 12 moves down.

Figure 6:
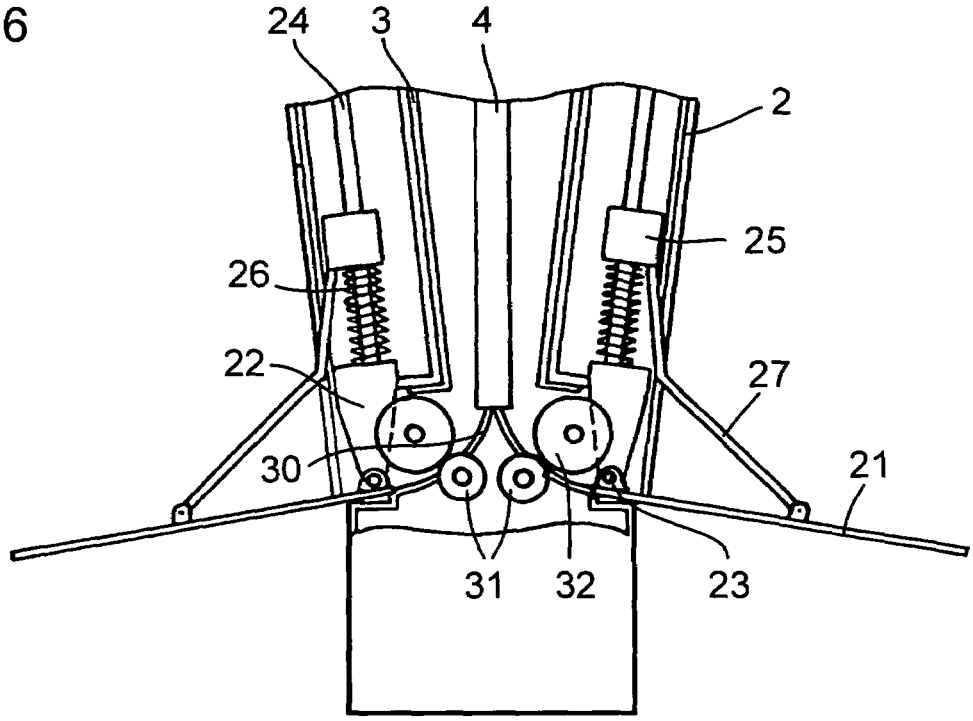
FIG. 6 is partial cross sectional view of the press showing a first embodiment of the means used to guide and catch the lower part of the trousers.
Figure 7:
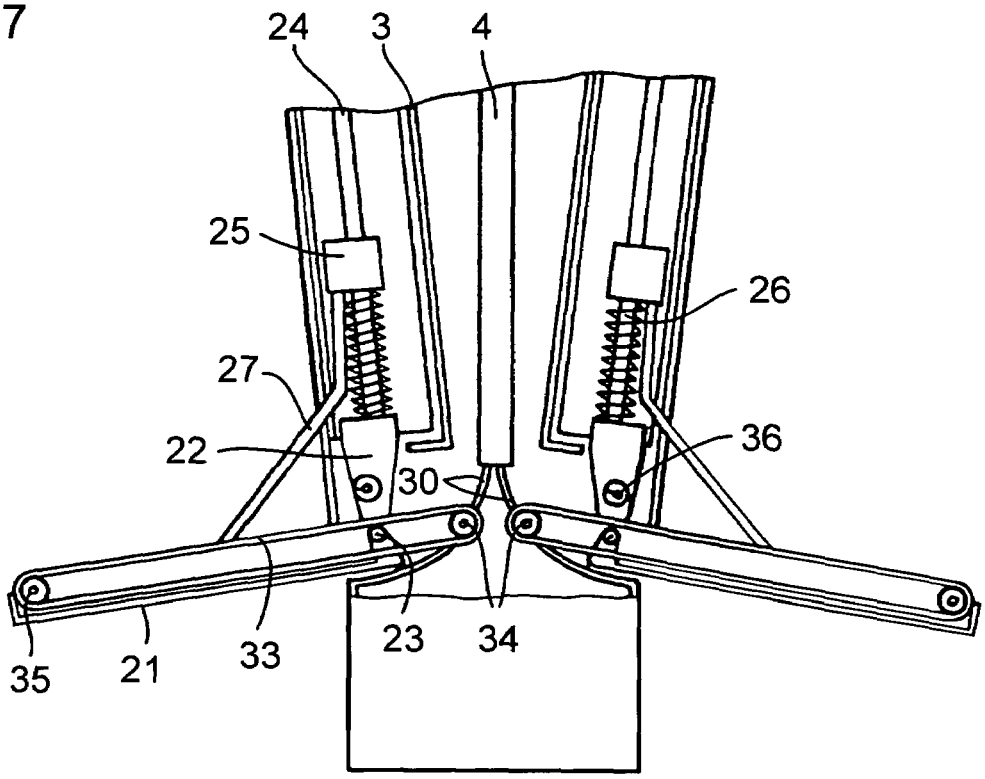
FIG. 7 is a partial cross sectional view of the press showing of a second embodiment of the means used to guide and catch the lower part of the trousers when the press is in open position.

Two alternate embodiments of the catching/stretching means will be disclosed with reference to FIGS. 6 and 7. Referring to FIG. 6, a pair of guiding rollers 31 are installed in the vicinity of the guiding surface 30 and rollers 32, driven in rotation by a motor, are extracting by friction the lower part of the trousers along the folding doors 21.

The catching and stretching means of the trousers can alternatively be designed as an endless belt 33 shown at FIG. 7. The endless belt 33 is installed between rollers 34 and 35 and is driven in movement by the rollers 34.

Figure 8:
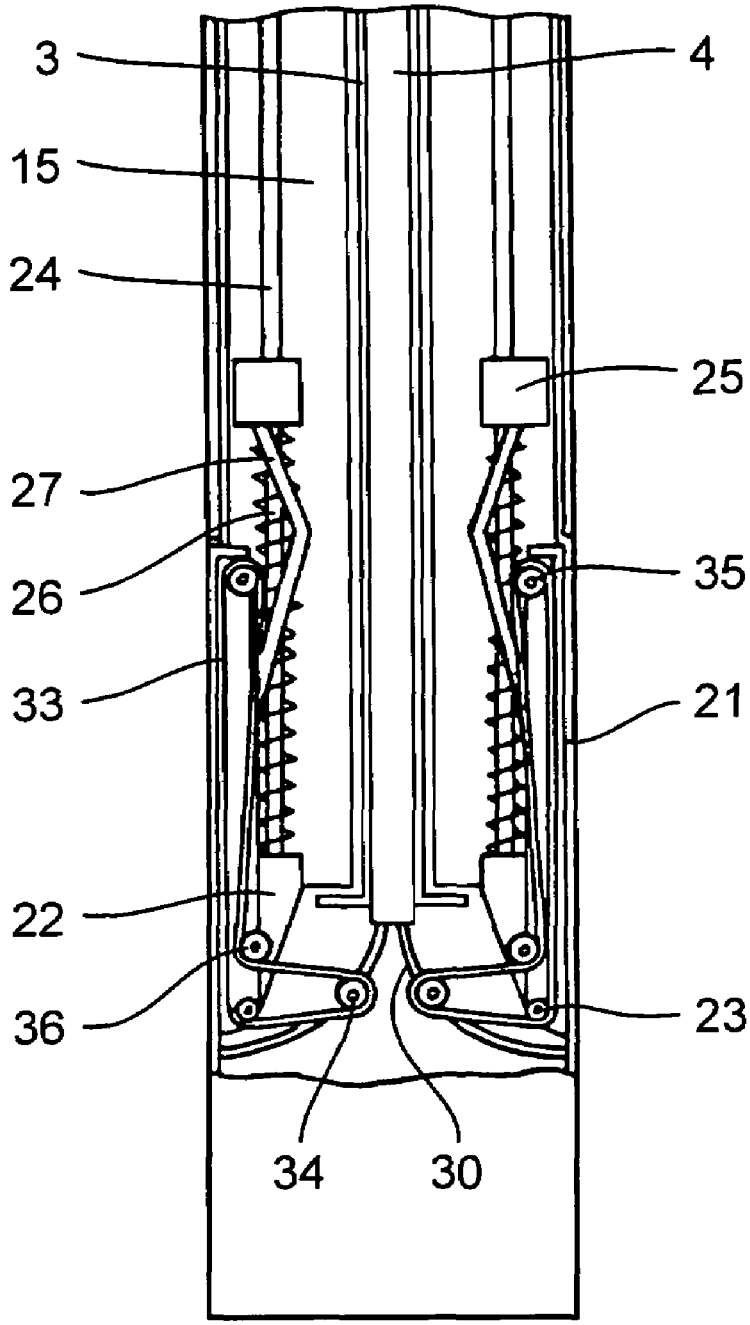
FIG. 8 is a view similar to FIG. 7 when the ironing press is closed.

The axle 36 are used to tension the belt 33 at the end of the ironing process, when the folding doors are closed as illustrated at FIG. 8.

Preferably, the folding doors 21 are manufactured from the same material as the housings, so that, in closed position, they tightly occlude the windows 20. This facilitates the transportation of the press, avoid dust penetration in the closed/rest position and improves the exterior design of the apparatus.

Advantageously the press 1 according to the invention will comprise a water tank and a pump 28 installed in the lower part of the base 8. The pump 28 is connected to spraying nozzles 29 installed in the upper part of the housing 2. The water tank can be removable or permanent. Preferably, the spraying nozzles 29 are pivotally mounted on an axle so as to extend from the housing 2 in operating position so as to facilitate water spraying. In the closed position of the press, the spraying nozzles may be folded so as to be integrated in the housing.

In the preferred embodiment, the heating elements (not shown) are installed in the housing 2 behind the pressing ironing plates 3. Alternatively, the heating element can be installed in the dividing plate 4.

Figure 9:
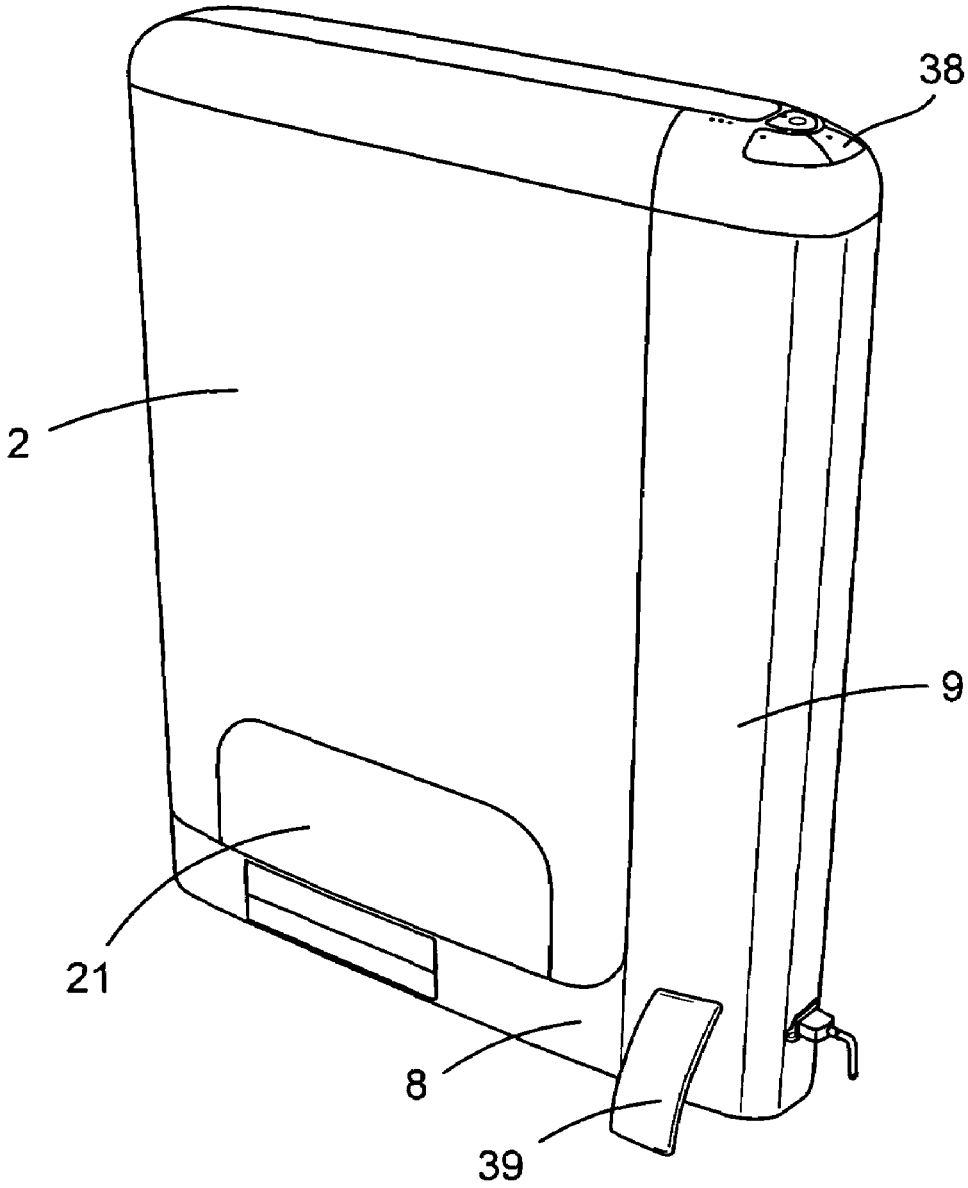
FIG. 9 is a perspective view of the press in closed position.
Figure 10:
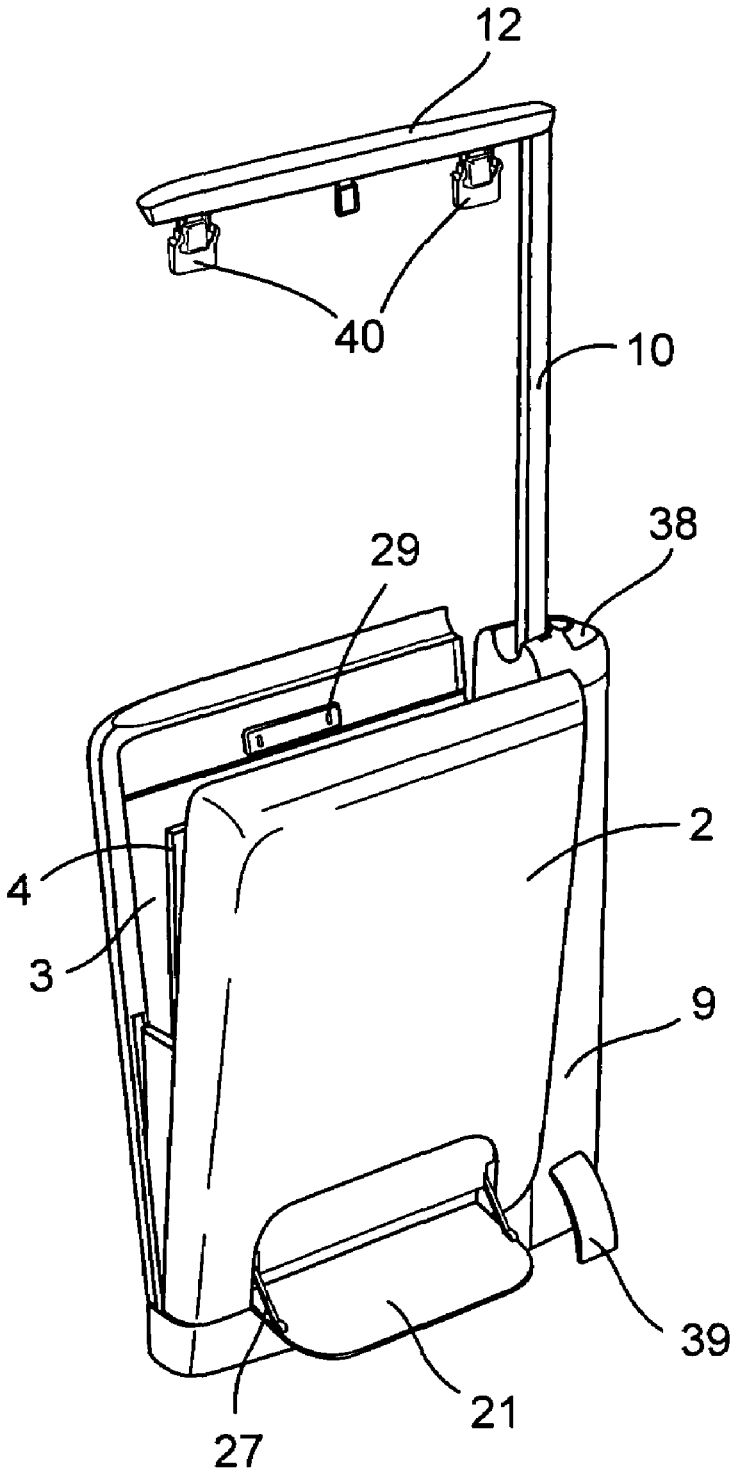
FIG. 10 is a perspective of the press illustrated at FIG. 9 in open position.

FIGS. 9 and 10 are perspective views of the press respectively in closed and open position. The control panel 38 installed in the upper part of the vertical part 9 of the base is easily reachable by the user. The press 1 also includes supporting elements 39 located in the lower part 8 of the base in order to increase the stability of the press on the ground. These supporting element may vary in shape and size. Grippers 40 are installed on the arm 12 to hold the waist of the trousers.

Operating the press will now be described in greater details hereunder. FIGS. 1, 4, 9 shows the initial position before the start. The press 1 is linked to the power source. The arm 12 rigidly linked to the shaft 10 lays between the pressing ironing plates 3. After switching on the press, the driving gear moves up the extended shaft 10 and the arm 12 linked with it and moves down the slider 19, that opens the pressing ironing plates 3. During its move down in the inclined slots 18, the slider 19 pushes down the slider 25, which turns the folding door 21 in the open position as shown at FIGS. 2, 3, 10 thanks to the levers 27.

During the rising of the slider 19, the sliders 25 are released and moved upward under the action of the springs 26 which causes the closing of the folding doors 21.

At FIGS. 2 and 3, the extended shaft 11 is shown in three different positions I II and III. At position III, the trousers are hanged on the arm 12 thanks to the gripping device installed on ft. Each leg being installed on one opposite side of the dividing plate 4. After selecting ironing condition (timing, temperature) on the control panel 38, the arm 12 connected to the extended shaft 11 goes down to the initial position.

The trousers are then ironed between the pressing ironing plates 3 and the dividing plate 4. The end part of the legs of the trousers are extracted through the windows 20 thank to the catching and stretching mechanism. Once the ironing process is terminated, the arm 12 moves up again and the pressing ironing plates are opened.

When the trousers come through the folding doors 21, the pump pumps the water from the tank into the nozzles 29 and the trousers are sprayed. One part of the water sprays the trousers and another part falls on the heated surface of the pressing ironing plate 3 and becomes steam. As the pressing ironing plates 3 and the folding doors 21 are closing at this moment the steam rises the top part of the trousers (higher than legs) in the cut 5 of the dividing plate 4 and between concave surfaces 6.

The water falling on the trousers during the spraying becomes steam, and therefore allows also the ironing of the folds on the top part (because they extend above the concave surfaces 6 and go to the flat part of the pressing ironing plates) and the ironing of the top part of the trousers.

Then the pressing ironing plates 3 are open and the arm 12 is extended in the position I (FIGS. 2, 3) and after spraying the pressing ironing plates 3 ate closed again. In this position another part of the trousers may be ironed. Then the cycles repeat when in the arm 12 is in position II and III. After finishing the ironing process of the last part of the trousers in the position III the pressing ironing parts open so that the trousers may be removed from the arm 12. Then after taking the trousers out the press is automatically folded in the initial position.

The portable automatic ironing press for the trousers according to the invention has the following advantages:

- allows the quality ironing of many types of trousers on their total length excluding deformation and fabric damage;
- has compact design and is also simple, comfortable and economic in exploitation;
- has simple controls;
- the ironing process is electronically controlled that allows the safety of the work;
- has low cost.

The present invention can be used to service as a home appliance and as an ironing press for the trousers in hotels, in small laundry shops and other similar services.

What is claimed is:

1. Compact automated ironing trousers press characterised it that it comprises a central dividing plate (4) linked to a base (7) and two housings (2), each comprising a pressing ironing plate (3) said housings (2) being articulated on the base (7) on each side of the central dividing plate (4) as well as means for urging the two housing (2) against the central dividing plate (4); the base (7) comprising an horizontal lower part (8) rigidly connected to at least one lateral vertical part (9) which comprises a vertically movable extended shaft (10) linked to an horizontal arm (12) provided with means (40) for holding the waist of the trousers to be ironed; and in that it further comprises heating means, an electronic control bloc, a control panel and at least one driving gear to open/close the pressing ironing plates (3) and to operate the extended shaft (10).

2. Press according to claim 1, characterised in that the housings (2) include, in their lower part, an opened window (20) through which the lower part of the trousers can be discharged during ironing operation, folding doors (21) for closing the windows (20) and means (31, 32, 33, 34, 35) for catching and stretching the lower part of the trousers.

3. Press according to claim 1, characterised in that the pressing ironing plates are mounted on hinges (15), articulated on the base (7), the edge of said hinges (15) comprising a longitudinal inclined slot (18) in which a slider element (19) may be moved under the action of a driving gear and transmission means.

4. Press according to claim 3, characterised in that the folding doors (21) are actuated by the slider element (19) of the opening/closing means of the press.

5. Press according to claim 2, characterised in that the means for catching and stretching the lower part of the trousers are constituted of a guiding surface (30) extending from the central dividing plate (4) to the folding doors (21) and rollers (31, 32) for guiding and driving the lower part of the trousers through the windows (20).

6. Press according to claim 2, characterised in that the means for catching and stretching the lower part of the trousers are constituted of a guiding surface (30) extending from the central dividing plate (4) to the folding doors (21) and an endless belt mounted on rollers (34, 35).

7. A press according to claim 1, characterised in that the central dividing plate (4) is rigidly fixed on the base (7) and in that each pressing ironing plate (3) is independently articulated on the base thanks to an independent axle (14).

8. Press according to claim 1, characterised in that each pressing ironing plate (3) includes a heating element.

9. Press according to claim 1, characterised in that the central dividing plate (4) has an upper opening shaped to receive the waist of the trousers and in that the pressing ironing plates (3) have a concave recess (6) in their upper part linked by form with the opening (5) of the central plate (4).

10. Press according to claim 1 characterised in that it comprises a water tank and a pump connected through pipes to spraying nozzles (39) mounted in the upper part of the housing (2).

11. Press according to claim 2, characterised in that the pressing ironing plates are mounted on hinges (15), articulated on the base (7), the edge of said hinges (15) comprising a longitudinal inclined slot (18) in which a slider element (19) may be moved under the action of a driving gear and transmission means.

* * * * *